US011492219B2

(12) United States Patent
Yamashita

(10) Patent No.: US 11,492,219 B2
(45) Date of Patent: Nov. 8, 2022

(54) SHEET FEEDING APPARATUS AND IMAGE FORMING SYSTEM

(71) Applicant: FUJIFILM Business Innovation Corp., Tokyo (JP)

(72) Inventor: Tatsuya Yamashita, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 281 days.

(21) Appl. No.: 16/849,989

(22) Filed: Apr. 15, 2020

(65) Prior Publication Data

US 2021/0103244 A1 Apr. 8, 2021

(30) Foreign Application Priority Data

Oct. 3, 2019 (JP) ..... JP2019-182987

(51) Int. Cl.
*B65H 1/26* (2006.01)
*G03G 15/00* (2006.01)
*B65H 3/48* (2006.01)

(52) U.S. Cl.
CPC ..... *B65H 1/266* (2013.01); *B65H 3/48* (2013.01); *G03G 15/6529* (2013.01); *B65H 2405/114* (2013.01); *B65H 2511/12* (2013.01)

(58) Field of Classification Search
CPC . B65H 1/04; B65H 1/266; B65H 3/48; B65H 2405/114; B65H 2405/1144; B65H 2511/12
See application file for complete search history.

(56) References Cited

U.S. PATENT DOCUMENTS 9,902,578 B2 * 2/2018 Wakabayashi ..... B65H 1/24
2012/0061908 A1 * 3/2012 Ueda ..... B65H 1/08 271/162

(Continued)

FOREIGN PATENT DOCUMENTS

JP 2010-105777 5/2010

*Primary Examiner* — Prasad V Gokhale
(74) *Attorney, Agent, or Firm* — JCIPRNET

(57) ABSTRACT

A sheet feeding apparatus includes a tray that stores a recording medium in a closed state in which the tray is placed in an apparatus body, the tray being capable of being pulled out from the apparatus body in a predetermined pulling direction; a transport unit that is provided on the apparatus body and that transports the recording medium in a direction crossing the pulling direction when the tray is in the closed state; a first contact portion provided on the tray and having a contact surface spaced from the transport unit when viewed in the pulling direction, the first contact portion being located upstream of the transport unit in the pulling direction and the contact surface being in contact with an upstream end portion of the recording medium stored in the tray in the pulling direction when the tray is in the closed state; a second contact portion disposed at a position that is upstream of the transport unit in the pulling direction and at which the second contact portion overlaps the transport unit when viewed in the pulling direction, the second contact portion having a contact surface that is in contact with the end portion when the tray is in the closed state; a first overlapping portion provided on the first contact portion and disposed downstream of the second contact portion in the pulling direction, the first overlapping portion overlapping the second contact portion when viewed in the pulling direction; and an urging portion that urges the second contact portion downstream in the pulling direction so that the second contact portion abuts against the first overlapping portion when the tray is in the closed state.

20 Claims, 10 Drawing Sheets

(56) References Cited

U.S. PATENT DOCUMENTS

| | | | | |
|---|---|---|---|---|
| 2013/0214483 | A1* | 8/2013 | Hirahara | B65H 1/00 271/147 |
| 2015/0108713 | A1* | 4/2015 | Yoshitsugu | B65H 1/04 271/217 |
| 2017/0255153 | A1* | 9/2017 | Eguchi | B65H 1/04 |

* cited by examiner

SHEET FEEDING APPARATUS AND IMAGE FORMING SYSTEM

CROSS-REFERENCE TO RELATED APPLICATIONS

This application is based on and claims priority under 35 USC 119 from Japanese Patent Application No. 2019-182987 filed Oct. 3, 2019.

BACKGROUND

(i) Technical Field

The present disclosure relates to a sheet feeding apparatus and an image forming system.

(ii) Related Art

Japanese Unexamined Patent Application Publication No. 2010-105777 describes a large-capacity sheet feeding apparatus and an image forming apparatus including the sheet feeding apparatus. The sheet feeding apparatus has no disadvantages in terms of the strength of a sheet-stacking base for receiving paper sheets of various sizes from a large size to a very small size, and is capable of easily and stably performing width regulation and switching of an air blowing state for paper sheets of various basis weights.

SUMMARY

Aspects of non-limiting embodiments of the present disclosure relate to a sheet feeding apparatus in which a contact unit that contacts an upstream end portion of a recording medium in a pulling direction in which a tray is pulled is disposed to overlap a transport unit when viewed in the pulling direction, the tray being capable of being pulled out from an apparatus body.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a sheet feeding apparatus including a tray that stores a recording medium in a closed state in which the tray is placed in an apparatus body, the tray being capable of being pulled out from the apparatus body in a predetermined pulling direction; a transport unit that is provided on the apparatus body and that transports the recording medium in a direction crossing the pulling direction when the tray is in the closed state; a first contact portion provided on the tray and having a contact surface spaced from the transport unit when viewed in the pulling direction, the first contact portion being located upstream of the transport unit in the pulling direction and the contact surface being in contact with an upstream end portion of the recording medium stored in the tray in the pulling direction when the tray is in the closed state; a second contact portion disposed at a position that is upstream of the transport unit in the pulling direction and at which the second contact portion overlaps the transport unit when viewed in the pulling direction, the second contact portion having a contact surface that is in contact with the end portion when the tray is in the closed state; a first overlapping portion provided on the first contact portion and disposed downstream of the second contact portion in the pulling direction, the first overlapping portion overlapping the second contact portion when viewed in the pulling direction; and an urging portion that urges the second contact portion downstream in the pulling direction so that the second contact portion abuts against the first overlapping portion when the tray is in the closed state.

BRIEF DESCRIPTION OF THE DRAWINGS

An exemplary embodiment of the present disclosure will be described in detail based on the following figures, wherein.

DETAILED DESCRIPTION

Figure 1:
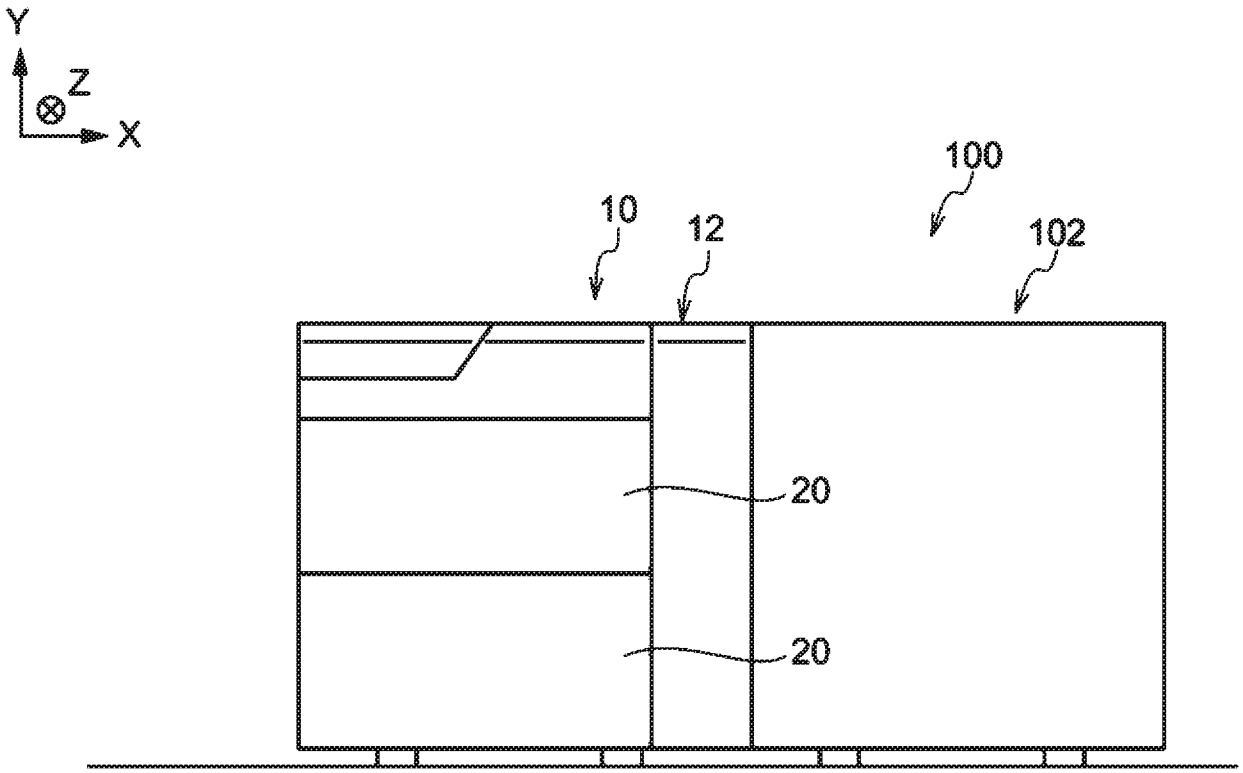
FIG. 1 is a front view of an image forming system including a sheet feeding apparatus according to an exemplary embodiment.

An exemplary embodiment for carrying out the present disclosure (hereinafter referred to as "exemplary embodiment") will now be described. In the following description, the direction shown by arrow X in the drawings is defined as an apparatus width direction, and the direction shown by arrow Y as an apparatus height direction. The direction orthogonal to both the apparatus width direction and the apparatus height direction (direction of arrow Z) is defined as an apparatus depth direction.

Structure of Image Forming System

An image forming system 100 according to the exemplary embodiment is an image forming system that forms an image on a sheet member P, which is an example of a recording medium. As illustrated in FIG. 1, the image forming system 100 includes an image forming apparatus 102 that forms an image on the sheet member P and a sheet feeding apparatus 10 that transports the sheet member P to the image forming apparatus 102. The image forming apparatus 102 is an electrophotographic image forming apparatus including an image forming unit and a transport unit therein. The image forming unit forms an image on the sheet member P. The transport unit transports the sheet member P to the image forming unit. The sheet feeding apparatus 10 is disposed adjacent to a side portion of the image forming apparatus 102 in the apparatus width direction. The sheet feeding apparatus 10 is attached to the image forming apparatus 102 as an optional device for the image forming apparatus 102, and is available by itself. The image forming unit included in the image forming apparatus 102 is not limited to an electrophotographic image forming unit.

Structure of Sheet Feeding Apparatus

As illustrated in FIG. 1, the sheet feeding apparatus 10 includes a housing 12, which is an example of an apparatus body, storage units 20, and transport devices 14 (see FIG. 2), which are an example of a transport unit. The housing 12 has a rectangular parallelepiped shape that extends in the apparatus height direction. The transport devices 14 transport sheet members P stored in the storage units 20 to the image forming apparatus 102. The storage units 20 store the sheet members P therein. The sheet feeding apparatus 10 according to the present exemplary embodiment includes two storage units 20 that are stacked in the apparatus height direction. The storage units 20 will be described in detail below. The sheet feeding apparatus 10 according to the present exemplary embodiment includes one transport device 14 for each of the two storage units 20. The transport devices 14 are disposed in the housing 12 at positions close to the image forming apparatus 102 in the apparatus width direction in upper regions of the respective storage units 20. In other words, the transport devices 14 overlap portions (contact units 30 described below) of the respective storage units 20 in the apparatus depth direction. Each transport device 14 includes a pick-up unit 14A and a pair of transport rollers (not shown). The transport device 14 picks up the uppermost one of the stored sheet members P with the pick-up unit 14A and feeds the sheet member P to the pair of transport rollers, which transport the sheet member P toward the image forming apparatus 102 while nipping the sheet member P therebetween. Thus, the sheet member P is supplied to the image forming apparatus 102. The structure of the transport unit included in the sheet feeding apparatus 10 is not limited to the above-described structure.

Storage Unit

Figure 4:
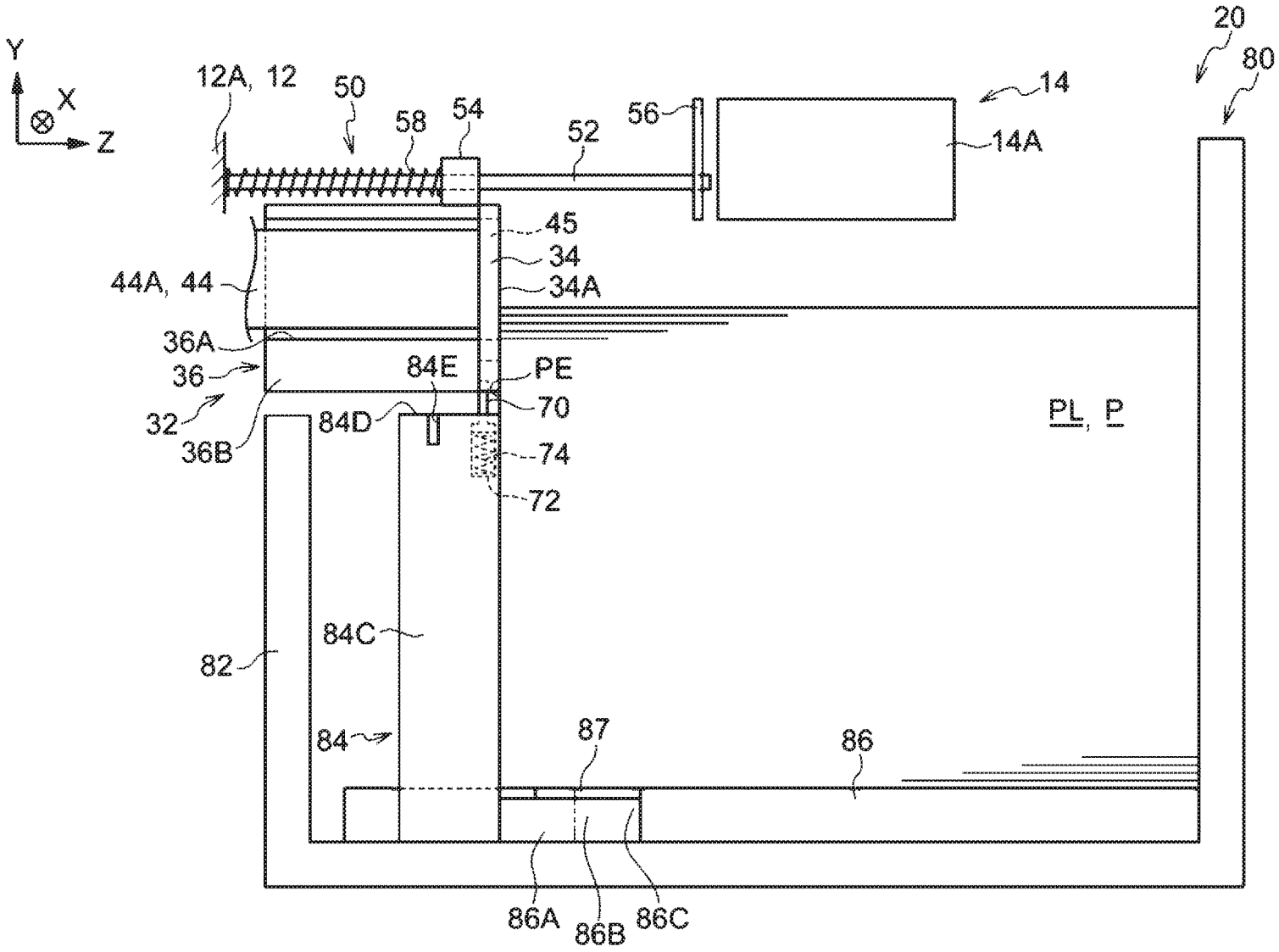
FIG. 4 is a sectional view taken along line IV,V-IV,V in FIG. 2 when a tray is placed in the sheet feeding apparatus according to the exemplary embodiment.
Figure 7:
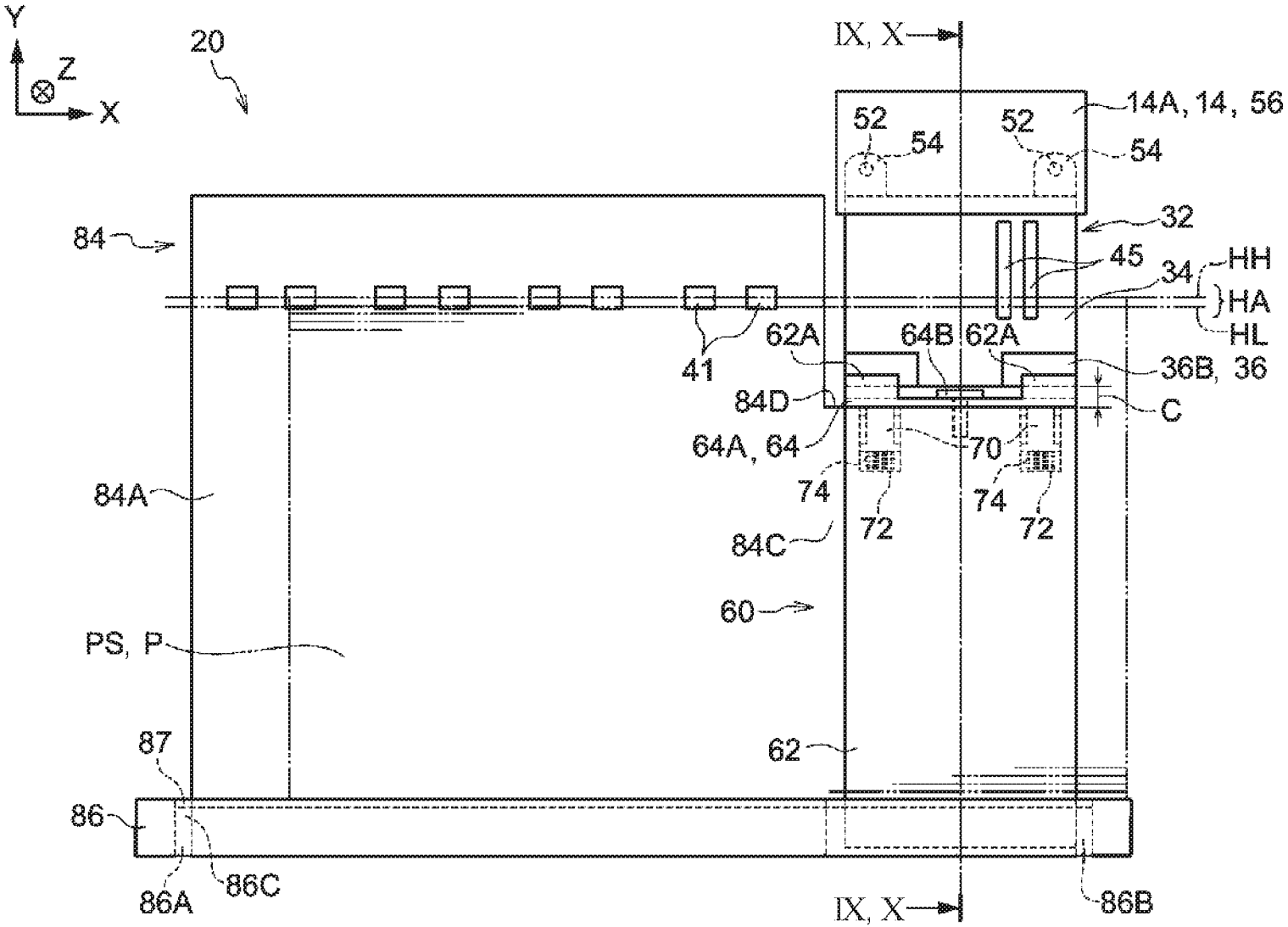
FIG. 7 is a front view illustrating the inside of the storage unit of the sheet feeding apparatus to which the optional guide according to the exemplary embodiment is attached.

Referring to FIG. 4, each storage unit 20 includes a drawer unit 80, a contact unit 30, a sliding mechanism 50, and a protecting plate 56. The storage unit 20 is capable of storing the sheet members P of different types having different widths in the apparatus depth direction. Here, the expression "capable of storing the sheet members P" means that, as described below, the storage unit 20 is configured such that the sheet members P are placed in a tray 82 while the contact unit 30 (at least a sub-guide 32) is in contact with end portions PE of the sheet members P at the far side in the apparatus depth direction. Among the sheet members P capable of being stored in the storage units 20, sheet members P having a maximum width are referred to as wide sheets PL, and sheet members P having a minimum width are referred to as narrow sheets PS. As illustrated in FIG. 4, the storage unit 20 is capable of storing the wide sheets PL when an optional guide 60 is not attached. As illustrated in FIG. 7, the storage unit 20 is capable storing the narrow sheets PS when the optional guide 60 is attached. In the following description of the storage unit 20, the storage unit 20 without the optional guide 60 attached thereto will be described first, and then the storage unit 20 having the optional guide 60 attached thereto will be described.

Storage Unit without Optional Guide

The storage unit 20 without the optional guide 60 attached thereto as illustrated in FIG. 4 will now be described.

Drawer Unit

As illustrated in FIG. 4, the drawer unit 80 includes the tray 82, a sheet stacking plate 86, a shutter 87, a raising-lowering device (not shown), and a sensor (not shown).

Tray

The tray 82 is a box-shaped member with an open top that sis disposed in the housing 12. The tray 82 is supported by a tray-sliding mechanism (not shown) provided in the housing 12 such that the tray 82 in a closed state, in which the tray 82 is placed in the housing 12, may be pulled out from the housing 12 toward the near side in the apparatus depth direction. The side wall of the tray 82 at the far side in the apparatus depth direction does not overlap the transport device 14 when viewed in the apparatus depth direction. In other words, the side wall of the tray 82 at the far side in the apparatus depth direction is spaced from the transport device 14 when viewed in the apparatus depth direction. Therefore, when the tray 82 in the closed state is pulled out, the tray 82 moves toward the near side in the apparatus depth direction without interfering with the transport device 14. At this time, the sheet stacking plate 86, the shutter 87, the raising-lowering device (not shown), and the sensor (not shown) move together with the tray 82. When the tray 82 is pulled out, the sheet members P may be placed into the tray 82 from above and stored in the tray 82. In the exemplary embodiment, the sheet members P stored in the tray 82 are transported by the transport device 14 with end portions thereof at the near side in the apparatus depth direction serving as a transport reference, the end portions being in contact with an inner wall of the tray 82 at the near side in the apparatus depth direction. Thus, the sheet feeding apparatus 10 of the exemplary embodiment employs a side registration system.

Sheet Stacking Plate

Figure 3:
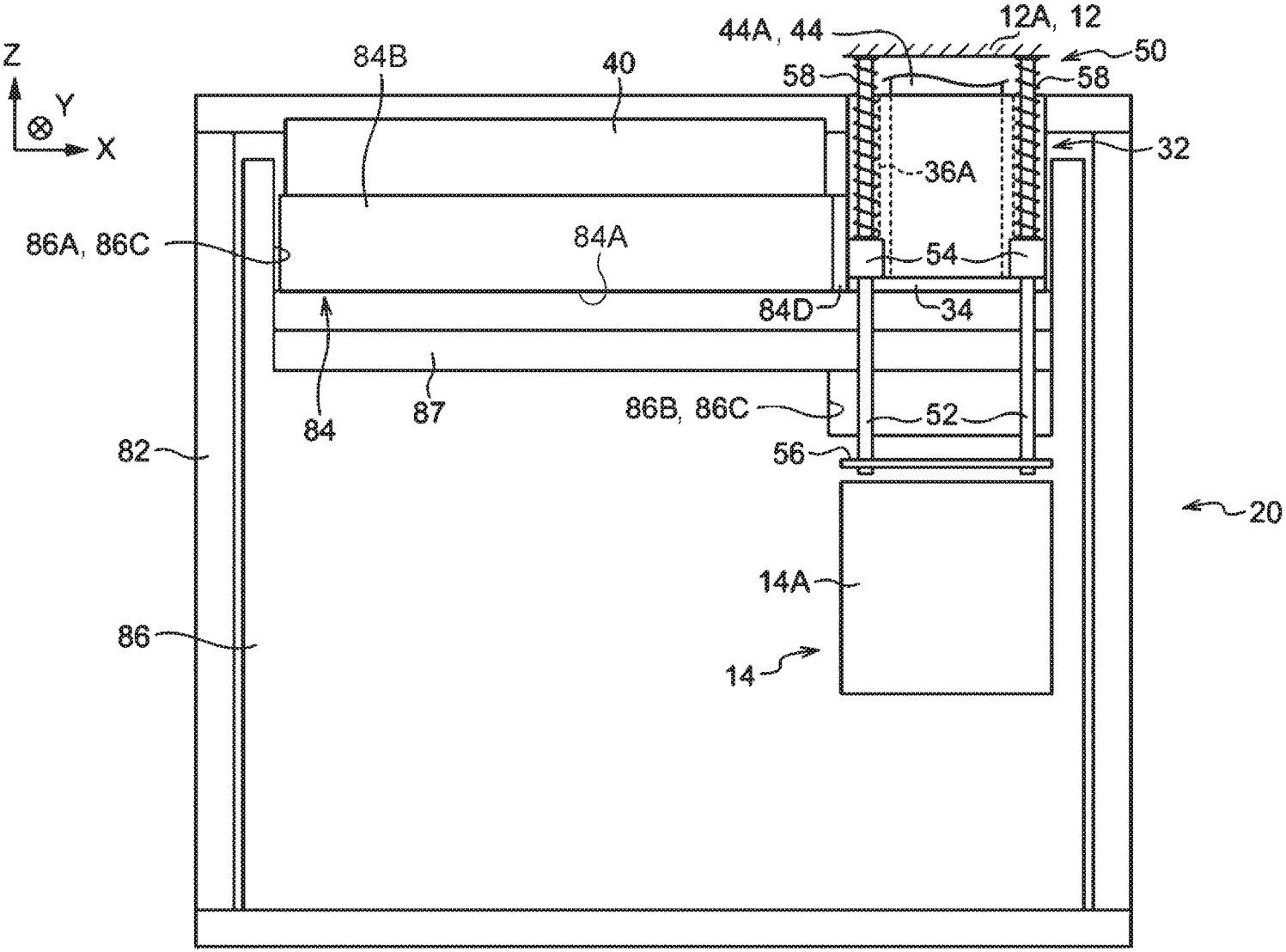
FIG. 3 is a top plan view illustrating the inside of the storage unit of the sheet feeding apparatus according to the exemplary embodiment.

The sheet stacking plate 86 is a rectangular plate disposed at the bottom of the tray 82, and the sheet members P are stacked on the upper surface of the sheet stacking plate 86. As illustrated in FIG. 3, an end portion of the sheet stacking plate 86 at the far side in the apparatus depth direction has a rectangular cut portion 86A that extends therethrough in the apparatus height direction in a region excluding both ends of the end portion. In addition, an edge portion of the cut portion 86A that extends in the apparatus width direction has a rectangular cut portion 86B that extends therethrough in the apparatus height direction in a region close to the image forming apparatus 102. A portion of the contact unit 30 (side guide 84 described below) is disposed in the cut portion 86A. The cut portion 86A enables the side guide 84 disposed in the cut portion 86A to be moved relative to the tray 82 in the apparatus depth direction by a guide-sliding mechanism described below. The upper edges of the cut portion 86A and the cut portion 86B define an opening 86C.

The sensor (not shown) detects the position of the uppermost one of the sheet members P stacked on the sheet stacking plate 86 with respect to the upper surface of the sheet stacking plate 86 in the apparatus height direction. The sensor is provided on, for example, an upper portion of the contact unit 30 or an upper portion of an end guide that is in contact with end portions PE of the sheet members P at a side opposite to the side adjacent to the image forming apparatus 102 in the apparatus width direction. The raising-lowering device (not shown) raises the sheet stacking plate 86 in the apparatus height direction based on position information obtained by the sensor so that the uppermost sheet member P is in a predetermined range HA in the apparatus height direction when the tray 82 is in the closed state. More specifically, when the sensor detects that the uppermost sheet member P is at a lower limit HL of the range HA in the apparatus height direction, the raising-lowering device raises the sheet stacking plate 86 by a predetermined distance. Accordingly, the uppermost sheet member P reaches an upper limit HH of the range HA. The length of the range HA from the upper limit HH to the lower limit HL is, for example, 3 mm. The raising-lowering device may be, for example, a wire raising-lowering device. More specifically, when the tray 82 is in the closed state, the wire raising-lowering device raises the sheet stacking plate 86 by winding four wires that are connected to a winding mechanism and joined to four corners of the sheet stacking plate 86. When the tray 82 is pulled out, the wire raising-lowering device releases the wires from the winding mechanism so that the sheet stacking plate 86 moves downward due to gravity.

Contact Unit

Figure 2:
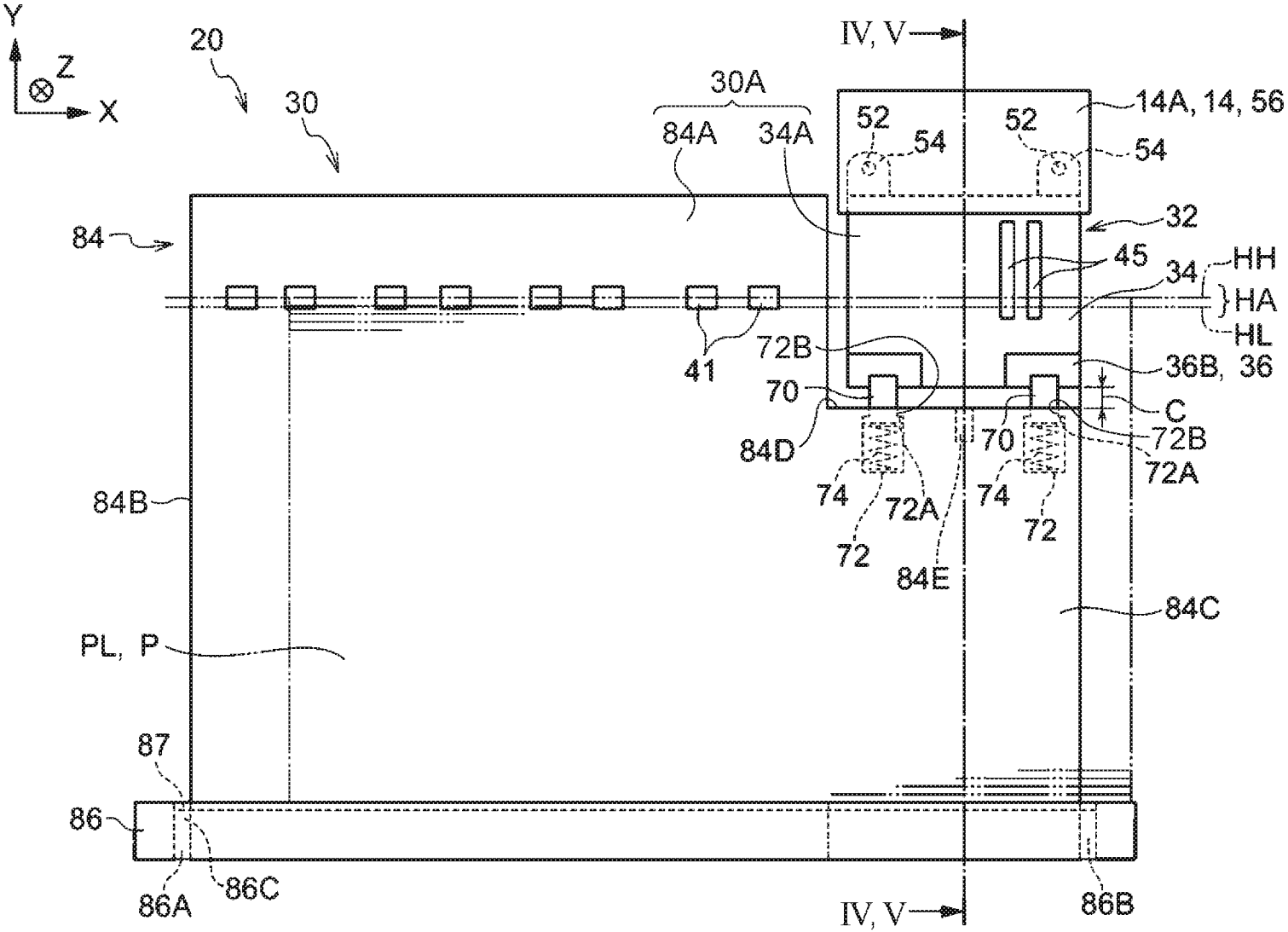
FIG. 2 is a front view illustrating the inside of a storage unit of the sheet feeding apparatus according to the exemplary embodiment.

Referring to FIG. 2, the contact unit 30 is a member including a contact surface 30A having a roughly rectangular shape when viewed in the apparatus depth direction. The contact surface 30A extends in the apparatus width direction and the apparatus height direction, and an upper corner thereof that is adjacent to the image forming apparatus 102 overlaps the transport device 14 when viewed in the apparatus depth direction. Referring to FIG. 4, when the tray 82 is in the closed state, the contact surface 30A is in contact with the end portions PE of the sheet members P stored in the tray 82 at the far side in the apparatus depth direction. As illustrated in FIG. 2, in the exemplary embodiment, the contact surface 30A is divided into two contact surfaces. More specifically, the contact surface 30A includes a contact surface 34A, which includes the corner that overlaps the transport device 14 and that extends over a region including the range HA in the apparatus height direction, and an L-shaped contact surface 84A, which extends over a region obtained by removing a rectangular region surrounding the contact surface 34A from the contact surface 30A. The contact surface 34A is T-shaped and extends in the apparatus height direction. The contact surface 34A contacts parts of the end portions PE in a region adjacent to the image forming apparatus 102. The L-shaped contact surface 84A does not overlap the transport device 14 when viewed in the apparatus depth direction. In other words, the L-shaped contact surface 84A is spaced from the transport device 14 when viewed in the apparatus depth direction. The contact unit 30 includes a side guide 84 having the L-shaped contact surface 84A and the sub-guide 32 having the T-shaped contact surface 34A.

Side Guide

As illustrated in FIG. 3, the side guide 84 is disposed in the cut portion 86A in the sheet stacking plate 86, and includes a body portion 84B, a first air-blowing device 40, first stoppers 70 (see FIGS. 2 and 4), and compression coil springs 74. As illustrated in FIG. 2, the body portion 84B is an L-shaped member having the contact surface 84A facing in the apparatus depth direction. The body portion 84B extends through the cut portion 86A in the apparatus height direction. The body portion 84B has a step in the uppermost surface thereof, and a portion recessed from the uppermost surface is referred to as a lower portion 84C (see FIG. 2). The side guide 84 is an example of a first contact portion having the contact surface 84A and positioned on the far side of the transport device 14 in the apparatus depth direction when the tray 82 is in the closed state.

As illustrated in FIG. 2, the lower portion 84C has two rectangular recesses 72 in an upper surface 84D thereof. Rib portions 72A are provided in upper regions of the recesses 72 to cover the peripheral edges of the recesses 72 when viewed in the apparatus height direction. The spaces in the recesses 72 that are surrounded by the rib portions 72A and that are open in the apparatus height direction are referred to as openings 72B. The recesses 72 are examples of separation spaces into which the first stoppers 70, which will be described below, are retracted.

As illustrated in FIGS. 2 and 4, the lower portion 84C has a threaded hole 84E in the upper surface 84D thereof. The threaded hole 84E is an example of an attachment portion to which the optional guide 60 is attached.

The body portion 84B has plural air holes 41. More specifically, the air holes 41 have rectangular openings in the contact surface 84A in a region above the upper surface 84D of the lower portion 84C, the rectangular openings extending over a region including the predetermined range HA in the apparatus height direction. The air holes 41 are arranged in the apparatus width direction.

Referring to FIG. 3, the first air-blowing device 40 is an example of an air-blowing unit provided on the body portion 84B at a side opposite to the contact surface 84A. The first air-blowing device 40 blows air against the sheet members P through the air holes 41 so that the sheet members P are raised (see FIGS. 2 and 4). The combination of the first air-blowing device 40 and the air holes 41 is an example of a separating unit that separates the sheet members P from each other in the apparatus height direction by blowing air against the sheet members P.

First Stopper

As illustrated in FIGS. 2 and 4, the first stoppers 70 are column-shaped members having the shape of an inverted letter 'T' when viewed in the apparatus width direction and the apparatus depth direction. Each first stopper 70 includes a rectangular-parallelepiped-shaped upper portion. The height of each first stopper 70 from the upper surface to the lower surface thereof is less than the depth of each recess 72. A lower portion of each first stopper 70 is disposed below the rib portion 72A of the corresponding recess 72, and is larger than the opening 72B when viewed in the apparatus height direction. The compression coil springs 74 are each disposed between the lower surface of the corresponding first stopper 70 and the bottom surface of the corresponding recess 72. The first stoppers 70 are urged upward by the compression coil springs 74, and the lower portions of the first stoppers 70 abut against the rib portions 72A of the recesses 72. As illustrated in FIG. 2, in this state, the upper portions of the first stoppers 70 project upward from the openings 72B of the recesses 72 such that the upper portions of the first stoppers 70 do not overlap the transport device 14 but overlap the sub-guide 32, which will be described below, when viewed in the apparatus depth direction. The first stoppers 70 are an example of a first overlapping portion that overlaps the sub-guide 32 when viewed in the apparatus depth direction.

When the first stoppers 70 receive downward force against the urging force applied by the compression coil springs 74, the first stoppers 70 move into the corresponding recesses 72. In other words, the first stoppers 70 are retracted into the recesses 72.

The side guide 84 is supported by a guide-sliding mechanism (not shown) provided at the bottom of the tray 82 such that the side guide 84 is movable in the apparatus depth direction in the cut portion 86A in the sheet stacking plate 86 (see FIG. 4). When the side guide 84 is moved by the guide-sliding mechanism to the farthest position in the apparatus depth direction, the tray 82 is capable of receiving the wide sheets PL. When the tray 82 is pulled toward the near side in the apparatus depth direction, the side guide 84 moves together with the tray 82 (see FIG. 5).

Sub-Guide

The sub-guide 32 includes a guide plate 34, which is a plate member having a T-shaped contact surface 34A, and a rectangular-parallelepiped-shaped hollow member 36 disposed on the far side of the guide plate 34 in the apparatus depth direction. The sub-guide 32 is an example of a second contact portion disposed at a position that is on the far side of the transport device 14 in the apparatus depth direction and at which the second contact portion overlaps the transport device 14 when viewed in the apparatus depth direction, the second contact portion having the contact surface 34A. As illustrated in FIG. 4, an upper portion of the hollow member 36 has a rectangular hole 36A that extends therethrough in the apparatus depth direction. An opening of the hole 36A at the near side in the apparatus depth direction is covered by the guide plate 34. As illustrated in FIG. 2, parts of the lower portion 36B of the hollow member 36 that are not covered by the guide plate 34 overlap the first stoppers 70 in the apparatus depth direction. In addition, a gap C is provided between the sub-guide 32 and the upper surface 84D of the lower portion 84C of the side guide 84 when viewed in the apparatus depth direction.

As illustrated in FIG. 2, the guide plate 34 has plural air holes 45. More specifically, the air holes 45 have rectangular openings in the contact surface 34A, the rectangular openings extending over a region including the predetermined range HA in the apparatus height direction. The air holes 45 are arranged in the apparatus width direction. The upper ends of the openings of the air holes 45 are closer to the transport device 14 than the upper ends of the air holes 41 in the side guide 84 are in the apparatus height direction. The air holes 45 are connected to the hole 36A in the hollow member 36.

Second Air-Blowing Device

As illustrated in FIG. 4, the second air-blowing device 44 includes a nozzle 44A provided on the sub-guide 32 at a side opposite to the contact surface 34A. The second air-blowing device 44 is an example of an air-blowing unit provided on the storage unit 20 and fixed to the housing 12. When the tray 82 is in the closed state, an end portion of the nozzle 44A is disposed in the hole 36A in the hollow member 36 of the sub-guide 32. The second air-blowing device 44 blows air against portions of the sheet members P stored in the tray 82 in a region near the image forming apparatus 102 through the hole 36A and the air holes 45, so that the sheet members P are raised. The combination of the second air-blowing device 44 and the air holes 45 is an example of a raising unit that raises the sheet members P stacked on the sheet stacking plate 86.

Sliding Mechanism

As illustrated in FIG. 4, the sliding mechanism 50 is a mechanism that is disposed on the far side of the transport device 14 in the apparatus depth direction and that supports the sub-guide 32 such that the sub-guide 32 is movable in the apparatus depth direction. The sliding mechanism 50 includes a pair of rails 52 that extend in the apparatus depth direction, sliders 54 provided on the sub-guide 32, and compression coil springs 58.

The pair of rails 52 are disposed above the sub-guide 32, and an end portion of each rail 52 that is opposite to an end portion adjacent to the transport device 14 is supported on an inner wall 12A of the housing 12.

The sliders 54 are provided on an upper portion of the hollow member 36 of the sub-guide 32, and are slidably attached to the pair of rails 52. The sliders 54 move together with the sub-guide 32.

The compression coil springs 58 are disposed between the inner wall 12A and the sliders 54, and each have one of the rails 52 extending therethrough. Both end portions of each compression coil spring 58 are in contact with the inner wall 12A and the corresponding one of the sliders 54 so that the sub-guide 32 is urged toward the neat side in the apparatus depth direction. When the tray 82 is in the closed state, the lower portion 36B of the hollow member 36 of the sub-guide 32 urged by the compression coil springs 58 abuts against the first stoppers 70 that project from the recesses 72 in the side guide 84. The compression coil springs 58 causes the lower portion 36B to abut against the first stoppers 70 so that the contact surface 34A of the sub-guide 32 is positioned to be on the same plane as the contact surface 84A of the side guide 84. The compression coil springs 58 are an example of an urging portion that urges the sub-guide 32 toward the near side in the apparatus depth direction so that the sub-guide 32 abuts against the first stoppers 70 when the tray 82 is in the closed state. The first stoppers 70 is an example of a first positioning unit that positions the sub-guide 32 with respect to the side guide 84 in the apparatus depth direction when the tray 82 is in the closed state.

As illustrated in FIG. 4, the protecting plate 56 is a rectangular plate (see FIG. 2) that is fixed to the housing 12 at a position between the transport device 14 and the sub-guide 32 in the apparatus depth direction and that includes a plate surface parallel to the contact surface 34A of the sub-guide 32. As illustrated in FIG. 4, when the tray 82 is in the closed state, the protecting plate 56 is disposed between the edge of the cut portion 86A in the sheet stacking plate 86 at the near side in the apparatus depth direction and the transport device 14 in the apparatus depth direction. The protecting plate 56 supports the end portions of the pair of rails 52 that are adjacent to the transport device 14. The protecting plate 56 is spaced from the side guide 84 and overlaps the sub-guide 32 when viewed in the apparatus depth direction. The protecting plate 56 is an example of a fixed member that is fixed to the housing 12 at a position that is between the transport device 14 and the sub-guide 32 in the apparatus depth direction and at which the fixed member overlaps the sub-guide 32 when viewed in the apparatus depth direction. The protecting plate 56 is an example of a second positioning unit that positions the sub-guide 32 at a predetermined position at which the sub-guide 32 is spaced from the side guide 84 in the apparatus depth direction when the tray 82 is pulled out.

Others

As illustrated in FIG. 4, the shutter 87 is a plate-shaped member that is removably attached to the opening 86C of the cut portion 86A in the sheet stacking plate 86 in a region on the near side of the side guide 84 in the apparatus depth direction. The shutter 87 expands and contracts in the apparatus depth direction in response to a movement of the side guide 84 in the apparatus depth direction to cover the opening 86C in the region on the near side of the side guide 84 in the apparatus depth direction. The shutter 87 is removed from the opening 86C when the optional guide 60 is attached to the contact unit 30.

As described above, the storage unit 20 of the sheet feeding apparatus 10 at least includes the tray 82, the side guide 84, the sub-guide 32, the first stoppers 70, the sliding mechanism 50 including the compression coil springs 58, and the protecting plate 56.

Storage Unit Having Optional Guide Attached

The storage unit 20 having the optional guide 60 attached thereto will now be described.

Figure 6:
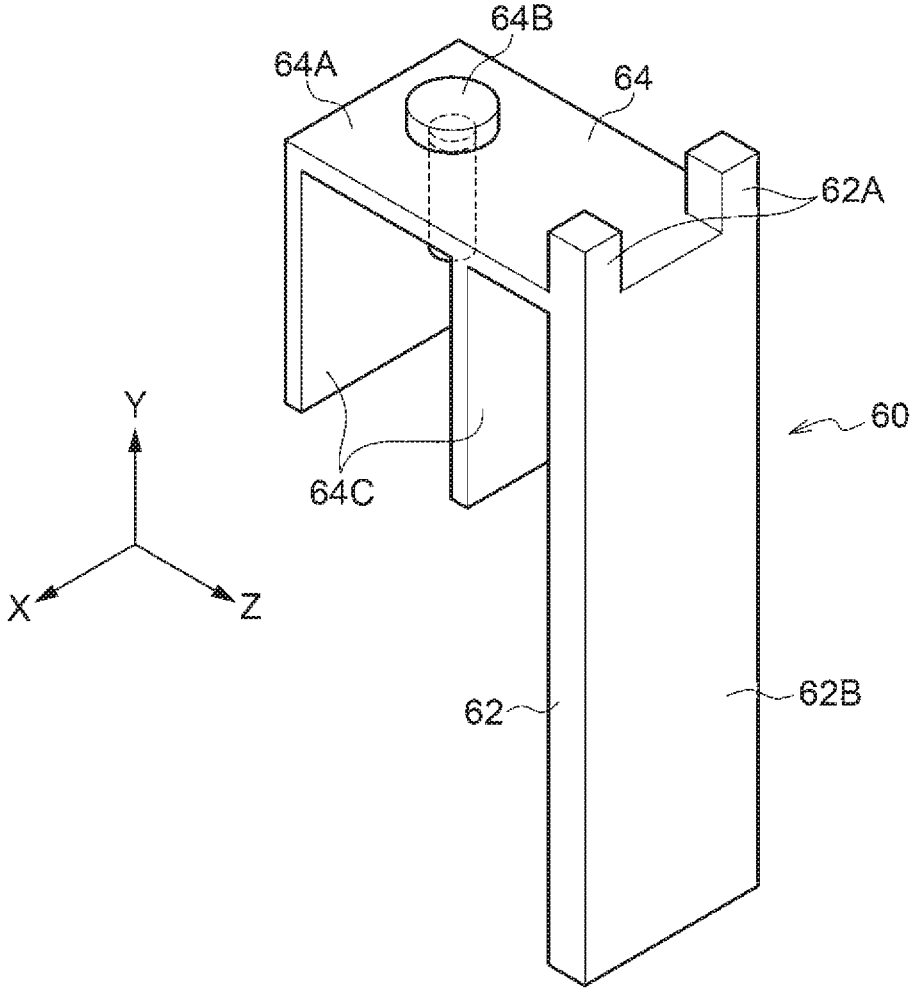
FIG. 6 is a perspective view of an optional guide according to the exemplary embodiment.

As illustrated in FIG. 6, the optional guide 60 includes a guide plate 62, which is a rectangular plate member that extends in the apparatus height direction and the apparatus width direction and a protruding portion 64 provided on the guide plate 62 at the far side of the guide plate 62 in the apparatus depth direction. The guide plate 62 is provided with second stoppers 62A that are rectangular-column-shaped and that extend upward from the upper surface of the guide plate 62 at both ends thereof in the apparatus width direction. The width of the guide plate 62 in the apparatus width direction is greater than the width of the gap between the two first stoppers 70 in the apparatus width direction. The gap between the two second stoppers 62A is greater than the width of a leg portion of the T-shaped guide plate 34 of the sub-guide 32 in the apparatus width direction.

The protruding portion 64 includes a plate portion 64A that is flat-plate-shaped and that extends from the upper surface of the guide plate 62 toward the far side in the apparatus depth direction and a screw 64B disposed in a through hole (not shown) formed in a plate surface of the plate portion 64A. The protruding portion 64 also includes two positioning plates 64C, which are two flat plates that project downward from the lower surface of the plate portion 64A so as to extend in the apparatus height direction and the apparatus width direction, and that are arranged next to each other in the apparatus depth direction. One of the positioning plates 64C that is on the far side in the apparatus depth direction extends from the end surface of the plate portion 64A at the far side in the apparatus depth direction. The two positioning plates 64C have the screw 64B disposed therebetween. The screw 64B includes a head position that is disposed above the plate portion 64A.

Figure 9:
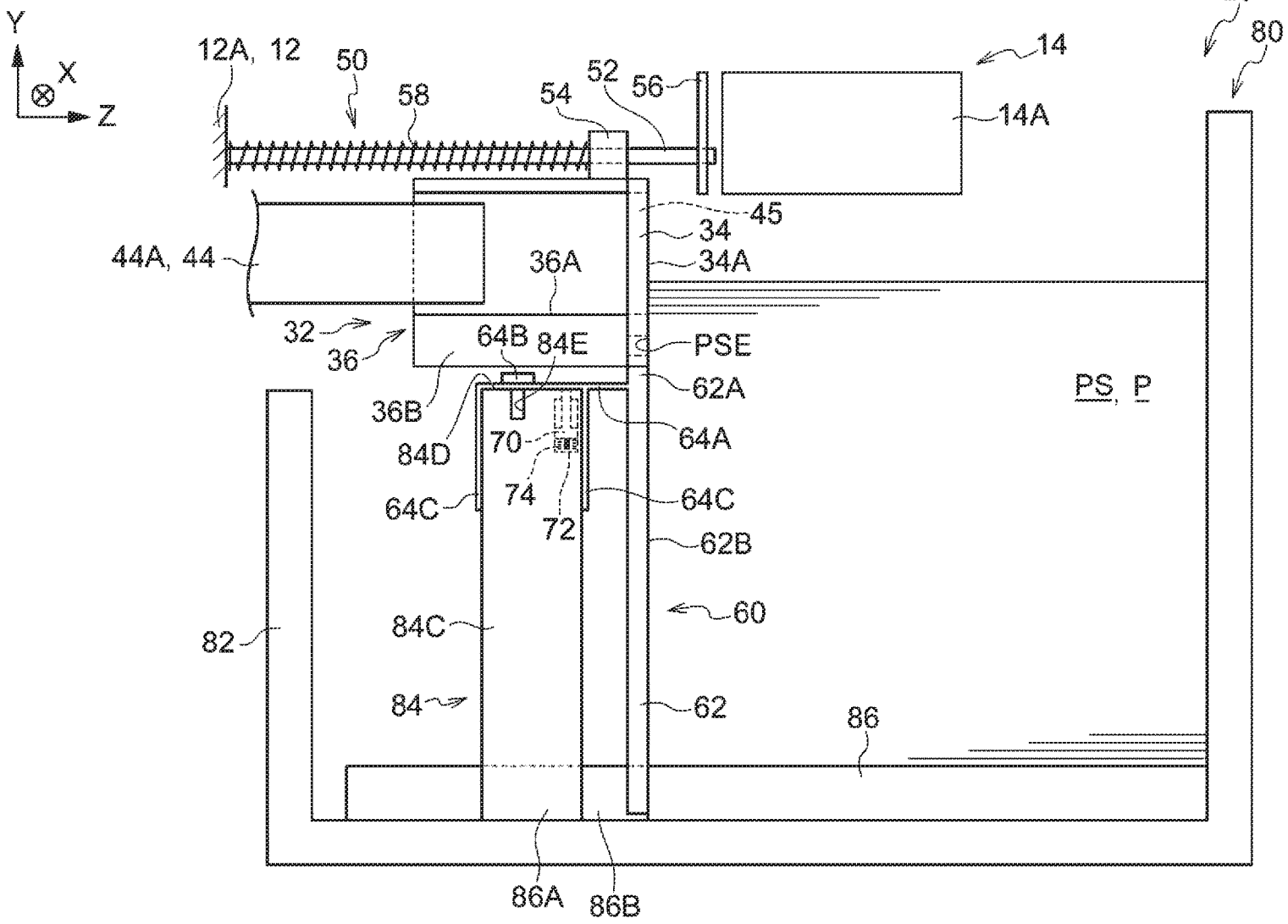
FIG. 9 is a sectional view taken along line IX,X-IX,X in FIG. 7 when the tray is placed in the sheet feeding apparatus according to the exemplary embodiment.

As illustrated in FIG. 9, the optional guide 60 is positioned with respect to the side guide 84 by orienting the optional guide 60 such that the guide plate 62 is on the near side of the positioning plates 64C in the apparatus depth direction and placing the two positioning plates 64C so as to clamp the lower portion 84C from above. In this state, the screw 64B is screwed into the threaded hole 84E in the lower portion 84C so that the optional guide 60 is attached to the side guide 84. The combination of the screw 64B on the protruding portion 64 and the threaded hole 84E in the side guide 84 is an example of a structure for attaching and removing the optional guide 60 to and from the side guide 84.

When the optional guide 60 is attached to the side guide 84, the first stoppers 70 are pressed from above by the plate portion 64A of the optional guide 60, and therefore receive downward force against the urging force applied by the compression coil springs 74. When the lower surface of the plate portion 64A and the upper surface 84D of the lower portion 84C of the side guide 84 come into contact with each other, the compression coil springs 74 contract and the first stoppers 70 are retracted into the recesses 72. At this time, the first stoppers 70 are retracted to separated positions at which the first stoppers 70 are spaced from the sub-guide 32 when viewed in the apparatus depth direction. When the optional guide 60 is in an attached state in which the optional guide 60 is attached to the side guide 84, the plate portion 64A and the lower portion 84C are screw-fastened together by the screw 64B and the threaded hole 84E. Therefore, the first stoppers 70 remains in the retracted state. The combination of the plate portion 64A and the screw 64B of the protruding portion 64 and the compression coil springs 74 and the threaded hole 84E of the side guide 84 are an example of a retracting structure for retracting the first stoppers 70 to the separated positions.

Figure 8:
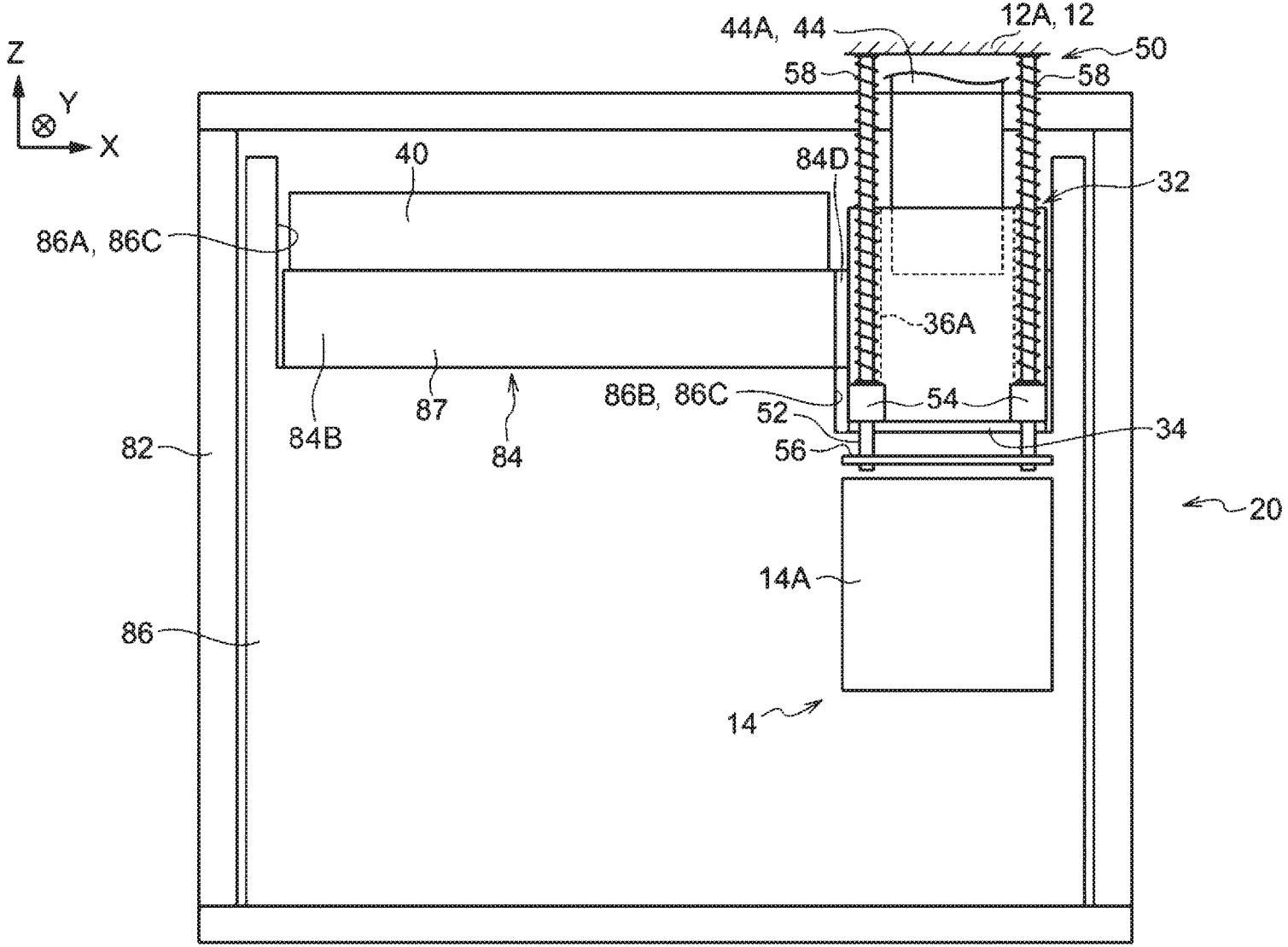
FIG. 8 is a top plan view illustrating the inside of the storage unit of the sheet feeding apparatus to which the optional guide according to the exemplary embodiment is attached.

As illustrated in FIGS. 8 and 9, when the optional guide 60 is in the attached state, the guide plate 62 is disposed in the cut portion 86B in the sheet stacking plate 86. In this state, as illustrated in FIG. 7, the second stoppers 62A do not overlap the transport device 14 or the protecting plate 56 when viewed in the apparatus depth direction. In other words, when the optional guide 60 is in the attached state, the second stoppers 62A are spaced from the transport device 14 and the protecting plate 56 when viewed in the apparatus depth direction. In addition, in this state, the second stoppers 62A overlap the lower portion 36B of the sub-guide 32 when viewed in the apparatus depth direction. Accordingly, as illustrated in FIG. 9, when the optional guide 60 is in the attached state and the tray 82 is in the closed state, the lower portion 36B of the sub-guide 32 urged by the compression coil springs 58 does not abut against the first stoppers 70, which are retracted, but abuts against the second stoppers 62A. When the lower portion 36B of the sub-guide 32 abuts against the second stoppers 62A, the contact surface 34A of the sub-guide 32 is positioned to be on the same plane as a guide surface 62B, which is a surface of the guide plate 62 of the optional guide 60 at the near side in the apparatus depth direction. The second stoppers 62A are an example of a second overlapping portion that is provided on the optional guide 60, that overlaps the sub-guide 32 when viewed in the apparatus depth direction while the optional guide 60 is in the attached state, and against which the sub-guide 32 urged by the compression coil springs 58 abuts when the first stoppers 70 are in the retracted state. The second stoppers 62A is an example of a third positioning unit that positions the sub-guide 32 with respect to the optional guide 60 in the apparatus depth direction when the optional guide 60 is in the attached state and the tray 82 is in the closed state.

When the optional guide 60 is in the attached state and the side guide 84 disposed in the cut portion 86A in the sheet stacking plate 86 is at the nearest position in the apparatus depth direction, a gap of 1 mm or less is provided between the guide plate 62 and the cut portion 86B in the apparatus depth direction. In this state, as illustrated in FIG. 9, when the tray 82 is in the closed state, the narrow sheets PS may be stored in the storage unit 20 such that end portions PSE of the narrow sheets PS stacked on the sheet stacking plate 86 at the far side in the apparatus depth direction (end portions PE of one type) are in contact with the contact surface 34A and the guide surface 62B. The optional guide 60 is an example of a third contact portion that is attachable to and removable from the side guide 84 and that is spaced from the transport device 14 in the attached state, the third contact portion having the guide surface 62B that is on the near side of the side guide 84 in the apparatus depth direction and in contact with the end portions PE when the optional guide 60 is in the attached state and the tray 82 is in the closed state.

Others

The sum of the thickness of the plate portion 64A and the thickness of the head portion of the screw 64B is less than the length of the gap C between the upper surface 84D of the lower portion 84C of the side guide 84 and the sub-guide 32 in the apparatus height direction. Therefore, as illustrated in FIGS. 7 and 9, the plate portion 64A and the screw 64B of the optional guide 60 in the attached state do not interfere with the sub-guide 32.

As illustrated in FIGS. 8 and 9, when the optional guide 60 is in the attached state and the tray 82 is in the closed state, the end portion of the nozzle 44A of the second air-blowing device 44 is disposed in the hole 36A in the sub-guide 32 that abuts against the second stoppers 62A. Therefore, when the optional guide 60 is in the attached state and the tray 82 is in the closed state, the sheet members P may be raised by the second air-blowing device 44.

Figure 10:
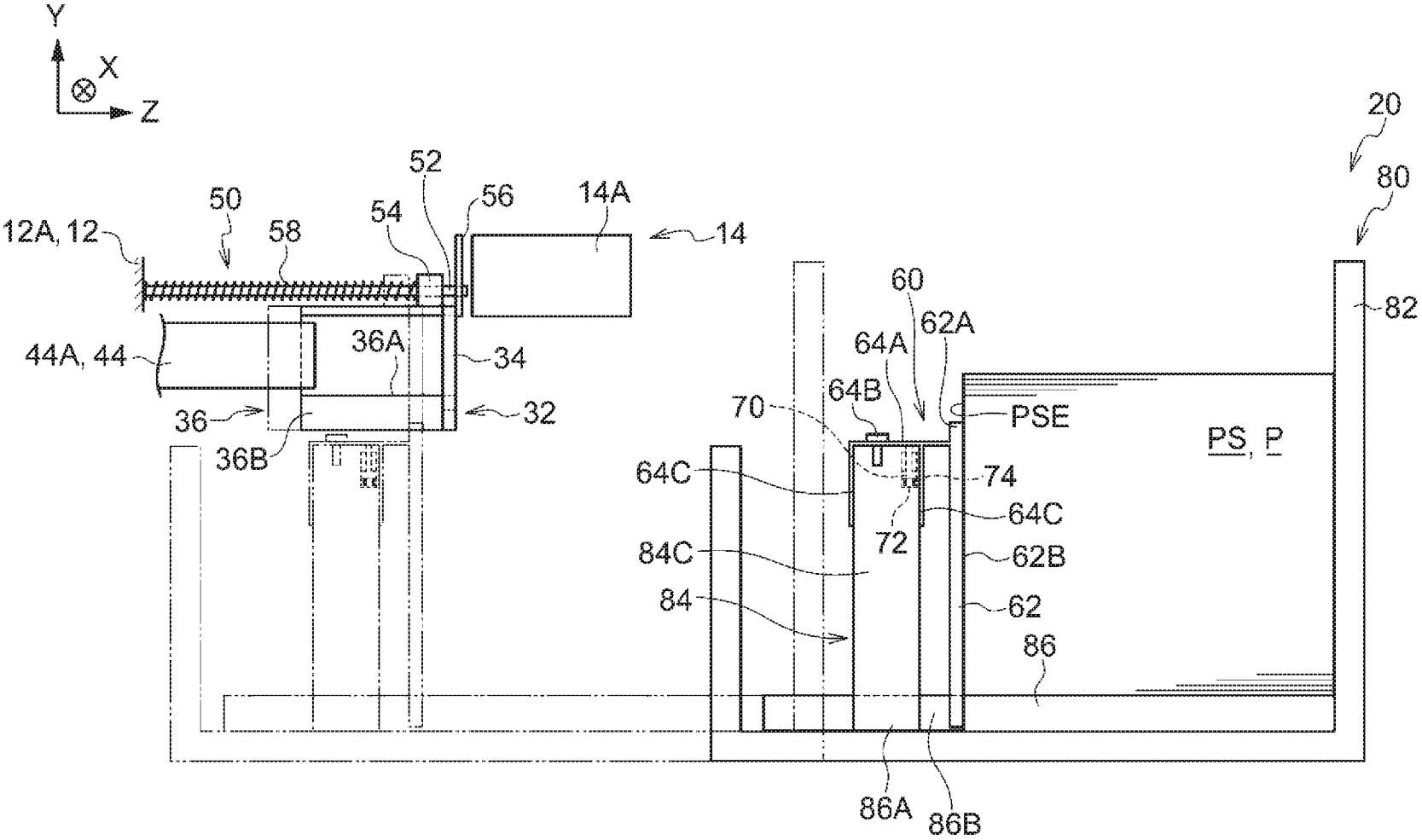
FIG. 10 is a sectional view taken along line IX,X-IX,X in FIG. 7 when the tray is pulled out from the sheet feeding apparatus according to the exemplary embodiment.

When the tray 82 is pulled toward the near side in the apparatus depth direction while the optional guide 60 is in the attached state, the optional guide 60 attached to the side guide 84 moves together with the side guide 84, which moves together with the tray 82, as illustrated in FIG. 10.

Operations and Effects

Operations and effects of the present disclosure will now be described. In the following description, when comparative examples and comparative devices to be compared with the present disclosure include components, for example, of the image forming system 100 according to the exemplary embodiment of the present disclosure, reference numerals and names of the components, for example, will be used.

Figure 5:
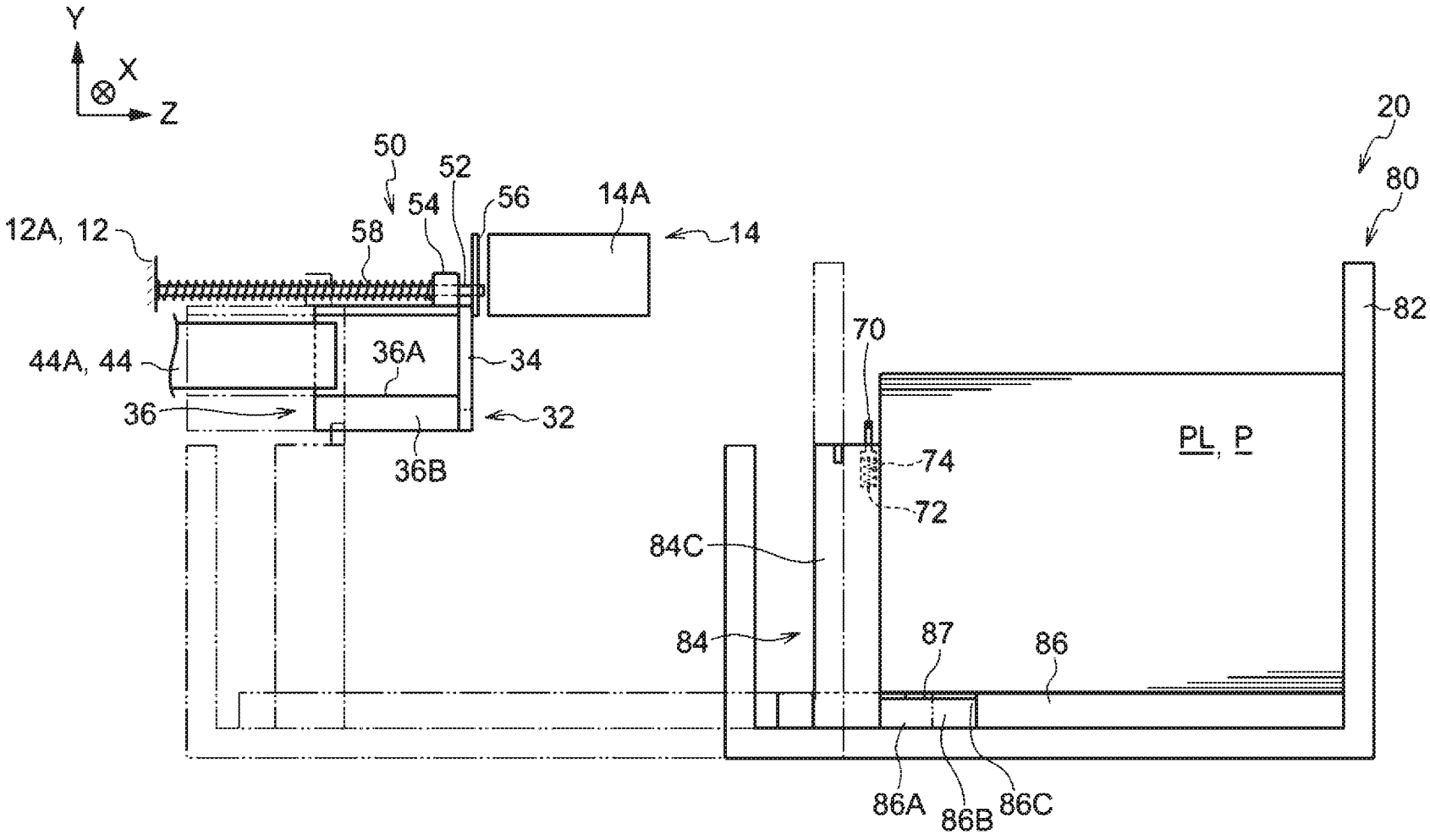
FIG. 5 is a sectional view taken along line IV,V-IV,V in FIG. 2 when the tray is pulled out from the sheet feeding apparatus according to the exemplary embodiment.

Assuming that the optional guide 60 is not attached to the storage unit 20, when the tray 82 is pulled out toward the near side in the apparatus depth direction, the side guide 84 and the first stoppers 70 move together with the tray 82 toward the near side in the apparatus depth direction, as illustrated in FIG. 5. At this time, the sub-guide 32, which receives the urging force of the compression coil springs 58 and abuts against the first stoppers 70 when the tray 82 is in the closed state, comes into contact with the protecting plate 56 as the tray 82 moves toward the near side in the apparatus depth direction.

The side guide 84 is separate from the sub-guide 32, and is spaced from the transport device 14 and the protecting plate 56 when viewed in the apparatus depth direction. Therefore, the side guide 84 moves together with the tray 82 toward the near side in the apparatus depth direction without interfering with the transport device 14 or the protecting plate 56. Thus, according to the sheet feeding apparatus 10 of the exemplary embodiment, the contact unit 30 is disposed to overlap the transport device 14 when viewed in the apparatus depth direction, and the tray 82 is capable of being pulled out from the housing 12 toward the near side in the apparatus depth direction.

As illustrated in FIG. 2, the sub-guide 32 according to the exemplary embodiment contacts parts of the end portions PE of the sheet members P stored in the tray 82 in a downstream region in a transporting direction. Therefore, according to the sheet feeding apparatus 10 of the exemplary embodiment, the risk of failure in transporting the recording medium is less than that in a sheet feeding apparatus in which the sub-guide 32 contacts the end portions of the sheet members P stored in the tray 82 only in an upstream region in the transporting direction.

As illustrated in FIG. 5, when the tray 82 is pulled out toward the near side in the apparatus depth direction, the sub-guide 32 comes into contact with the protecting plate 56 disposed on the far side of the transport device 14 in the apparatus depth direction when viewed in the apparatus depth direction. Therefore, according to the sheet feeding apparatus 10 of the exemplary embodiment, when the tray 82 is pulled out, the sub-guide 32 stops by coming into contact with the protecting plate 56 on the far side of the transport device 14 in the apparatus depth direction. Accordingly, the sub-guide 32 urged by the compression coil springs 58 does not come into contact with the transport device 14.

When the tray 82 of the storage unit 20 is pulled out toward the near side in the apparatus depth direction while the optional guide 60 is attached to the side guide 84, the side guide 84 moves together with the tray 82 toward the near side in the apparatus depth direction, as illustrated in FIG. 10. At this time, the optional guide 60 moves together with the side guide 84. Since the optional guide 60 is spaced from the transport device 14 and the protecting plate 56 when viewed in the apparatus depth direction, the optional guide 60 moves together with the tray 82 toward the near side in the apparatus depth direction without interfering with the transport device 14 or the protecting plate 56. Thus, according to the sheet feeding apparatus 10 of the exemplary embodiment, the contact unit 30 is disposed to overlap the transport device 14 when viewed in the apparatus depth direction, and the tray 82 is capable of being pulled out from the housing 12 toward the near side in the apparatus depth direction in the state in which the optional guide 60 attached.

According to the optional guide 60 of the exemplary embodiment, as illustrated in FIG. 9, the first stoppers 70 are caused to be retracted into the recesses 72 by the plate portion 64A and the screw 64B of the optional guide 60 when the optional guide 60 is attached to the side guide 84. In other words, the optional guide 60 according to the exemplary embodiment is provided with a retracting structure for causing the first stoppers 70 to be retracted into the recess 72. Thus, according to the sheet feeding apparatus 10 of the exemplary embodiment, the number of components is less than that of a sheet feeding apparatus including a retracting structure independent of the optional guide 60.

The sheet feeding apparatus 10 according to the exemplary embodiment includes a raising unit including the second air-blowing device 44 and the air holes 45 in the sub-guide 32. Thus, according to the sheet feeding apparatus 10 of the exemplary embodiment, air may be blown against the sheet members P, so that the risk of failure in transporting the recording medium is less than that in a sheet feeding apparatus in which only the side guide 84 is provided with a unit for raising the sheet members P.

According to the image forming system 100 including the sheet feeding apparatus 10 of the exemplary embodiment, the contact unit 30 is disposed to overlap the transport device 14 when viewed in the apparatus depth direction, and the tray 82 is capable of being pulled out from the housing 12 toward the near side in the apparatus depth direction.

Although a specific exemplary embodiment of the present disclosure has been described in detail, the present disclosure is not limited to the above-described exemplary embodiment, and various modifications, alterations, and improvements are possible within the technical idea of the present disclosure.

For example, according to the exemplary embodiment, the sheet feeding apparatus 10 employs a side registration system. However, the present disclosure may be applied to a sheet feeding apparatus that employs a center registration system. In such a case, two side guides are disposed symmetrically about the sheet members P in the apparatus depth direction. One of the two side guides that is at the far side in the apparatus depth direction has a structure similar to that of the exemplary embodiment and is divided into portions corresponding to the side guide 84 and the sub-guide 32 of the exemplary embodiment. The other side guide that is at the near side in the apparatus depth direction differs from the side guide at the far side in the apparatus depth direction, and a contact unit that contacts the end portions of the sheet members P at the near side in the apparatus depth direction has an integral structure.

According to the exemplary embodiment, the contact surface 34A of the sub-guide 32 contacts parts of the end portions PE of the sheet members P in a region close to the image forming apparatus 102. However, the sheet feeding apparatus according to the present disclosure is not limited to this as long as the sub-guide overlaps the transport device 14 when viewed in the apparatus depth direction, and may be such that the contact surface 34A of the sub-guide 32 contacts parts of the end portions PE of the sheet members P in a region far from the image forming apparatus 102.

According to the exemplary embodiment, the sheet feeding apparatus 10 includes the protecting plate 56. However, the sheet feeding apparatus according to the present disclosure may include no protecting plate 56. For example, the transport device 14 may be provided with a reinforcing structure at the far side in the apparatus depth direction.

According to the exemplary embodiment, the optional guide 60 is provided with the retracting structure for causing the first stoppers 70 to be retracted to the separated positions. However, according to the present disclosure, the retracting structure may be provided independently of the optional guide 60. For example, the retracting structure may be such that the first stoppers 70 are retracted to the separated positions by removing the first stoppers 70 from the side guide 84.

According to the exemplary embodiment, in the state in which the optional guide 60 is not attached, the first stoppers 70 are urged upward by the compression coil springs 72 so that the first stoppers 70 project and overlap the sub-guide 32 when viewed in the apparatus depth direction. When the optional guide 60 is in the attached state, the compression coil springs 72 contract so that the first stoppers 70 are retracted to the separated positions. However, the sheet feeding apparatus according to the present disclosure may include no compression coil springs 72 as long as the first stoppers 70 may be caused to project and retract. For example, the sheet feeding apparatus according to the present disclosure may include a structure for removably attaching the first stoppers 70 to the upper surface 84D of the lower portion 84C of the side guide 84.

According to the above-described exemplary embodiment, the sheet feeding apparatus 10 includes the first air-blowing device 40 and the second air-blowing device 44. However, the sheet feeding apparatus according to the present disclosure may include only one of the first air-blowing device 40 and the second air-blowing device 44. Also, the sheet feeding apparatus according to the present disclosure may include neither the first air-blowing device 40 nor the second air-blowing device 44.

According to the above-described exemplary embodiment, the guide plate 34 that covers the hollow member 36 of the sub-guide 32 at the near side in the apparatus depth direction is T-shaped, and two first stoppers 70 and two second stoppers 62A are provided. However, it is not necessary that the guide plate 34 be T-shaped as long as the contact surface 34A of the sub-guide 32 may be positioned with respect to the contact surface 84A of the side guide 84 and the guide surface 62B of the optional guide 60, and the number of first stoppers 70 is not limited to two. For example, the guide plate may be a rectangular plate that covers only an upper portion of the hollow member 36 at the near side in the apparatus depth direction. The number of first stoppers 70 and the number of second stoppers 62A may instead be one or three or more.

According to the above-described exemplary embodiment, the optional guide 60 is positioned with respect to the side guide 84 by clamping the lower portion 84C with the two positioning plates 64C of the optional guide 60. However, the number of positioning plates 64C is not limited to two as long as the optional guide 60 may be positioned with respect to the side guide 84. For example, the optional guide 60 may be positioned with respect to the side guide 84 by bringing one positioning plate 64C into contact with the lower portion 84C or the body portion 84B in the apparatus depth direction.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A sheet feeding apparatus comprising:

a tray that stores a recording medium in a closed state in which the tray is placed in an apparatus body, the tray being capable of being pulled out from the apparatus body in a predetermined pulling direction;

a transport unit that is provided on the apparatus body and that transports the recording medium in a direction crossing the pulling direction when the tray is in the closed state;

a first contact portion provided on the tray and having a contact surface spaced from the transport unit when viewed in the pulling direction, the first contact portion being located upstream of the transport unit in the pulling direction and the contact surface being in contact with an upstream end portion of the recording medium stored in the tray in the pulling direction when the tray is in the closed state;

a second contact portion disposed at a position that is upstream of the transport unit in the pulling direction and at which the second contact portion overlaps the transport unit when viewed in the pulling direction, the second contact portion having a contact surface that is in contact with the upstream end portion when the tray is in the closed state;

a first overlapping portion provided on the first contact portion and disposed downstream of an upstream portion of the second contact portion in the pulling direction, the first overlapping portion overlapping the second contact portion when viewed in the pulling direction; and an urging portion that urges the second contact portion downstream in the pulling direction so that the second contact portion abuts against the first overlapping portion when the tray is in the closed state.

2. The sheet feeding apparatus according to claim 1, wherein the second contact portion contacts a part of the upstream end portion in a downstream region in a transporting direction in which the recording medium is transported.

3. The sheet feeding apparatus according to claim 2, further comprising:

a fixed member that is fixed to the apparatus body at a position that is between the transport unit and the second contact portion in the pulling direction and at which the fixed member overlaps the second contact portion when viewed in the pulling direction.

4. The sheet feeding apparatus according to claim 3, further comprising:

a third contact portion that is attachable to and removable from the first contact portion and that is spaced from the transport unit when viewed in the pulling direction in an attached state in which the third contact portion is attached to the first contact portion, the third contact portion having a contact surface that is located downstream of the first contact portion in the pulling direction and that is in contact with the upstream end portion when the third contact portion is in the attached state and the tray is in the closed state;

a retracting structure that retracts the first overlapping portion to a separated position at which the first overlapping portion is spaced from the second contact portion when viewed in the pulling direction; and a second overlapping portion that is provided on the third contact portion, that overlaps the second contact portion when viewed in the pulling direction while the third contact portion is in the attached state, and against which the second contact portion urged by the urging portion abuts when the first overlapping portion is retracted to the separated position by the retracting structure.

5. The sheet feeding apparatus according to claim 4, wherein the first overlapping portion is supported such that the first overlapping portion is movable between the separated position and an overlapping position at which the first overlapping portion overlaps the second contact portion when viewed in the pulling direction, and is urged toward the overlapping position, and wherein the retracting structure is provided on the third contact portion and retracts the first overlapping portion to the separated position against an urging force applied to the first overlapping portion when the third contact portion is attached to the first contact portion.

6. The sheet feeding apparatus according to claim 5, further comprising:

a raising unit that raises the recording medium by blowing air against the recording medium stored in the tray through an air hole formed in the second contact portion.

7. The sheet feeding apparatus according to claim 4, further comprising:

a raising unit that raises the recording medium by blowing air against the recording medium stored in the tray through an air hole formed in the second contact portion.

8. The sheet feeding apparatus according to claim 3, further comprising:

a raising unit that raises the recording medium by blowing air against the recording medium stored in the tray through an air hole formed in the second contact portion.

9. The sheet feeding apparatus according to claim 2, further comprising:

a third contact portion that is attachable to and removable from the first contact portion and that is spaced from the transport unit when viewed in the pulling direction in an attached state in which the third contact portion is attached to the first contact portion, the third contact portion having a contact surface that is located downstream of the first contact portion in the pulling direction and that is in contact with the upstream end portion when the third contact portion is in the attached state and the tray is in the closed state;

a retracting structure that retracts the first overlapping portion to a separated position at which the first overlapping portion is spaced from the second contact portion when viewed in the pulling direction; and a second overlapping portion that is provided on the third contact portion, that overlaps the second contact portion when viewed in the pulling direction while the third contact portion is in the attached state, and against which the second contact portion urged by the urging portion abuts when the first overlapping portion is retracted to the separated position by the retracting structure.

10. The sheet feeding apparatus according to claim 9, wherein the first overlapping portion is supported such that the first overlapping portion is movable between the separated position and an overlapping position at which the first overlapping portion overlaps the second contact portion when viewed in the pulling direction, and is urged toward the overlapping position, and wherein the retracting structure is provided on the third contact portion and retracts the first overlapping portion to the separated position against an urging force applied to the first overlapping portion when the third contact portion is attached to the first contact portion.

11. The sheet feeding apparatus according to claim 10, further comprising:

a raising unit that raises the recording medium by blowing air against the recording medium stored in the tray through an air hole formed in the second contact portion.

12. The sheet feeding apparatus according to claim 9, further comprising:

a raising unit that raises the recording medium by blowing air against the recording medium stored in the tray through an air hole formed in the second contact portion.

13. The sheet feeding apparatus according to claim 2, further comprising:

a raising unit that raises the recording medium by blowing air against the recording medium stored in the tray through an air hole formed in the second contact portion.

14. The sheet feeding apparatus according to claim 1, further comprising:

a third contact portion that is attachable to and removable from the first contact portion and that is spaced from the transport unit when viewed in the pulling direction in an attached state in which the third contact portion is attached to the first contact portion, the third contact portion having a contact surface that is located downstream of the first contact portion in the pulling direction and that is in contact with the upstream end portion when the third contact portion is in the attached state and the tray is in the closed state;

a retracting structure that retracts the first overlapping portion to a separated position at which the first overlapping portion is spaced from the second contact portion when viewed in the pulling direction; and a second overlapping portion that is provided on the third contact portion, that overlaps the second contact portion when viewed in the pulling direction while the third contact portion is in the attached state, and against which the second contact portion urged by the urging portion abuts when the first overlapping portion is retracted to the separated position by the retracting structure.

15. The sheet feeding apparatus according to claim 14, wherein the first overlapping portion is supported such that the first overlapping portion is movable between the separated position and an overlapping position at which the first overlapping portion overlaps the second contact portion when viewed in the pulling direction, and is urged toward the overlapping position, and wherein the retracting structure is provided on the third contact portion and retracts the first overlapping portion to the separated position against an urging force applied to the first overlapping portion when the third contact portion is attached to the first contact portion.

16. The sheet feeding apparatus according to claim 15, further comprising:

a raising unit that raises the recording medium by blowing air against the recording medium stored in the tray through an air hole formed in the second contact portion.

17. The sheet feeding apparatus according to claim 14, further comprising:

a raising unit that raises the recording medium by blowing air against the recording medium stored in the tray through an air hole formed in the second contact portion.

18. The sheet feeding apparatus according to claim 1, further comprising:

a raising unit that raises the recording medium by blowing air against the recording medium stored in the tray through an air hole formed in the second contact portion.

19. An image forming system comprising:

an image forming apparatus that forms an image on a recording medium; and the sheet feeding apparatus according to claim 1 that transports the recording medium to the image forming apparatus.

20. A sheet feeding apparatus comprising:

a tray that stores a recording medium in a closed state in which the tray is placed in an apparatus body, the tray being capable of being pulled out from the apparatus body in a predetermined pulling direction;

a transport unit disposed in an upper region of a space inside the tray, the transport unit transporting the recording medium in a direction crossing the pulling direction when the tray is in the closed state;

a contact unit including a first contact portion and a second contact portion, the first contact portion moving to a position downstream of the transport unit and the second contact portion in the pulling direction when the tray is pulled out, the second contact portion being separate from the first contact portion, the first contact portion and the second contact portion being in contact with an upstream end portion of the recording medium stored in the tray in the pulling direction when the tray is in the closed state;

a first positioning unit that positions the second contact portion with respect to the first contact portion in the pulling direction when the tray is in the closed state; and a second positioning unit that positions the second contact portion at a predetermined position at which the second contact portion is spaced from the first contact portion in the pulling direction when the tray is pulled out.

* * * * *